US006447403B1

(12) United States Patent
Schmidt

(10) Patent No.: US 6,447,403 B1
(45) Date of Patent: Sep. 10, 2002

(54) METHOD AND APPARATUS FOR IMPROVING PUTTING SKILL

(76) Inventor: Karl B. Schmidt, 2454 N. 96th St., Wauwatosa, WI (US) 53226

( * ) Notice: Subject to any disclaimer, the term of this patent is extended or adjusted under 35 U.S.C. 154(b) by 0 days.

(21) Appl. No.: 09/659,229

(22) Filed: Sep. 11, 2000

(51) Int. Cl.[7] ..... A63B 69/36; A63B 53/04

(52) U.S. Cl. ..... 473/251; 473/294; 473/313; 473/330; 473/340; 473/409

(58) Field of Search ..... 473/293, 294, 473/204, 300, 409, 277, 212, 215, 252, 313, 340, 296, 251

(56) References Cited

U.S. PATENT DOCUMENTS 1,537,320 A * 5/1925 Marsh
1,548,081 A 8/1925 Wilson
2,212,651 A * 8/1940 Sanderson
2,843,384 A * 7/1958 Schmidt
3,188,086 A * 6/1965 Parmley
3,219,348 A * 11/1965 Dishner
3,394,937 A 7/1968 Allport
3,462,155 A 8/1969 Pelz
3,486,755 A * 12/1969 Hodge
4,073,492 A * 2/1978 Taylor
4,519,612 A * 5/1985 Tsao
4,880,240 A * 11/1989 Lewis
5,046,740 A * 9/1991 D'Eath
5,531,446 A * 7/1996 Scheie
5,595,385 A * 1/1997 Jablonski
5,616,089 A * 4/1997 Miller
5,772,523 A * 6/1998 Sheftic
5,800,283 A * 9/1998 Nomura

* cited by examiner

*Primary Examiner*—Sebastiano Passaniti
(74) *Attorney, Agent, or Firm*—Donald J. Ersler

(57) ABSTRACT

An improved method of swinging a putter includes an improved putter and a swinging stance of specific features. The elements of the swinging method include gripping the putter in the traditional fashion, securing at least one hand or a butt end of the hand grip against some part of the lower body, moving the putter head back through an arcuate path, and retracing the arcuate path to strike the golf ball. The improved putter includes a putter head attached to one end of the shaft, and hand grip attached to the other end of the shaft. In a second embodiment, the shaft extends from the putter head at an angle of between 35 to 85 degrees from the vertical axis.

23 Claims, 6 Drawing Sheets

METHOD AND APPARATUS FOR IMPROVING PUTTING SKILL

BACKGROUND OF THE INVENTION

1. Field of the Invention

The present invention relates generally to golf and more specifically to a method and apparatus for improving putting skill which enables a golfer to decrease the amount of variation during a putting stroke.

2. Discussion of the Prior Art

Putting methods and club designs have not changed dramatically for the last 100 years. The result of this lack of change has been a lack of improvement in putting skills by amateur as well as professional golfers.

The traditional putting methods are plagued with numerous sources of potential error, resulting in making the action so difficult that even few professionals have been able to master the task.

Furthermore, the great plethora of putter designs that are introduced to the marketplace yearly gives testimony to the fact that very few putters designs include all of the features that are necessary to optimize the equipment for the intended task of even traditional putting methods-even though the sport is approximately 400 years old. Accordingly, there is a clearly felt need in the art for a method and apparatus for improving putting skill which decreases the variation encountered during a putting swing and provides for a putter which is designed to optimize the properties critical to successful execution of such an improved putting stroke.

SUMMARY OF THE INVENTION

The present invention provides a method and apparatus for improving putting skill through an improved method of swinging the putter and the associated putter design.

An improved method of swinging a putter includes an improved putter and a swinging stance of specific features. The elements of the swinging method include gripping the putter in a traditional fashion (e.g. interlocking grip), securing at least one hand or a butt end of the hand grip against some part of the lower body, moving the putter head back through an arcuate path, and retracing the arcuate path to strike the golf ball. Preferably, the at least one hand or the butt end of the hand grip is placed against the leg closest to the target, just above the kneecap. The knee on which the golf club is resting may be extended forward to facilitate the swing.

The golfer may also place the improved putter against other areas of the lower body, besides above the kneecap. Other locations include farther up the thigh or inside the thigh (the closer to the femur, the better). The golfer may also rest his right elbow on his right thigh, and left elbow on the left thigh; only the right elbow on the right thigh; or only the left elbow on the left thigh. The main objective is that the end of the hand grip or hands are pivoted about the lower body (anywhere below the belt line) to produce an arcuate swing.

The improved putter head is preferably swung parallel to the ground. The improved putter head may be slid on the green or slid slightly above the green during the putting swing. It is preferable that the golfer orient his head such that his eyes look substantially vertically downward on the golf ball.

The improved putter includes a putter head, shaft, and hand grip. The putter head preferably has a substantially round cross section to reduce friction if the putter head is slid along the ground. Preferably, either end of the putter head may be used to strike a golf ball. A first end of the shaft is preferably attached to substantially a middle of an axial length of the putter head. The length of the shaft is at least 18 inches to conform to the United States Golfing Association (USGA) rules. The hand grip is attached to a second end of the shaft. Further to conform to USGA rules, the shaft must be bent within the first five inches from the insertion point into the putter head in such a manner as to tilt the shaft a minimum of 10 degrees toward the golfer in the formal putting address position.

A second embodiment of an improved putter includes a putter head, shaft, and hand grip. The putter head preferably includes a "ID" shaped putter body (as viewed from a top and commonly referred to as a mallet design) with a hard rod inserted therein. An end of the hard rod is placed in the center of the putter body, flush with the putter head's face. The hard rod may extend the full distance to the back of the putter body or only part of the way. A front of the hard rod strikes the golf ball. A bottom of the body is essentially flat, but rounded up on all edges which could come in contact with the ground during a swing. The angle of the shaft relative to the putter head may be an angle from 35 to 85 degrees from a vertical axis. Preferably, the angle of the shaft relative to the putter head (lie angle) is such that it would allow a golfer to place at least one hand or a butt end of the hand grip above the knee cap. The lie angle will vary, because each person has a different length of leg. The length of the shaft is at least 18 inches to conform to the USGA rules. The hand grip is attached to a second end of the shaft.

The lie angle of the traditional putter, that is the angle defined by the tilt away from vertical, and perpendicular to the intended flight line of the ball, in degrees, requires that golfers must place and maintain a gripping location of the putter with the hands, any where between 6 to 12 inches away from the body, the latter distance almost the norm. This means that the forearms and elbows are at a concomitant distance as well.

This posture requires that golfers must swing a club in a manner that is pendulum in nature, and do so with the controlling segments of the body that are significantly distal from the ball, the body, and most importantly from any part of the body that could both provide support and reduce physically the degrees of freedom inherent in the stroke. This condition results in both counter-productive backstroke and downstroke actions. Golfers rarely take the club back in a straight or repeatable fashion, and rarely return the head square to the ball, or at the sweet spot of the club. Since the traditional putting method permits a stroke that is free to vary both in back and downstroke, it does so. Thus putting is very rarely mastered, even by professionals.

Were a golfer to attempt to use a traditional putter with the invented method described herein, the conditions would not permit successful putting. For example, resting the gripped end of a traditional putter on the knee, would result in the putter head pointing awkwardly and highly above the horizon, exposing a much smaller hitting surface for the ball at impact. Furthermore, the putter's heel is not be designed favorably to slide along or slightly above the ground. The heel would most likely catch the ground, and also the toe would have a tendency to tilt either left or right, depending upon its weighing, affecting the club face angle. Other problems are encountered by attempting to use a traditional putter with a traditional stance, and the attempting to get the putter stroke to move in an arc either along the ground or slightly above it.

In addition, to the requirement of tilting the shaft considerably more towards the golfer, other modifications are employed to optimize putters design for the improved putting method. The traditional putter head is poorly designed for the task of arcuate or pivot putting. Traditional putter heads have rounded soles that catch and stub when moved back and forth along the ground. This roundness also mitigates against setting up a putter head so that its sole lies parallel to the ground, a position that ideally should be maintained throughout the identified stroke.

Prior art putters are designed both geometrically and via weight distribution in a manner that offers some correction for preventing mishits, particularly strokes that result in ball contact being made either to the left or right of the club's sweet spot. This is a very common occurrence, since even professionals often miss the sweet spot. The typical design modification to assist in correcting mishits is to use heel and toe weighing, placing most of the mass to the distal ends of the putter head. Since the pivot putting method provides for a very high probability of sweet spot contact, the putter can be designed with most of its mass directly behind the sweet spot, where it should be.

It is possible to modify a prior art putter such that it would appear to work with the previously disclosed improved putting method. The shaft of the modified prior art putter would be slowly radiused in a negatively decelerating curve towards the golfer. The radiused shaft provides serious energy transfer problems during the putt; the inertia of the modified prior art putter would be lost due to its tendency to want to twist in the golfer's hands. Further, prior art putters have soles that are radiused up perpendicularly across the entire base. The prior art putters are also radiused inappropriately for a back swing along the ground. Thus there exists a high probability that the club would stub itself on the grass in both swing directions.

Accordingly, it is an object of the present invention to provide an improved method of swinging a putter which allows a golfer to dramatically increase the controllability of the ball's path and therefore decrease the number of strokes during a round of golf.

Finally, it is another object of the present invention to provide an improved putter which optimizes the properties of a putter for the disclosed improved stroke, thereby decreasing the number of strokes during golf.

These and additional objects, advantages, features and benefits of the present invention will become apparent from the following specification.

DETAILED DESCRIPTION OF THE PREFERRED EMBODIMENTS

Figure 1:
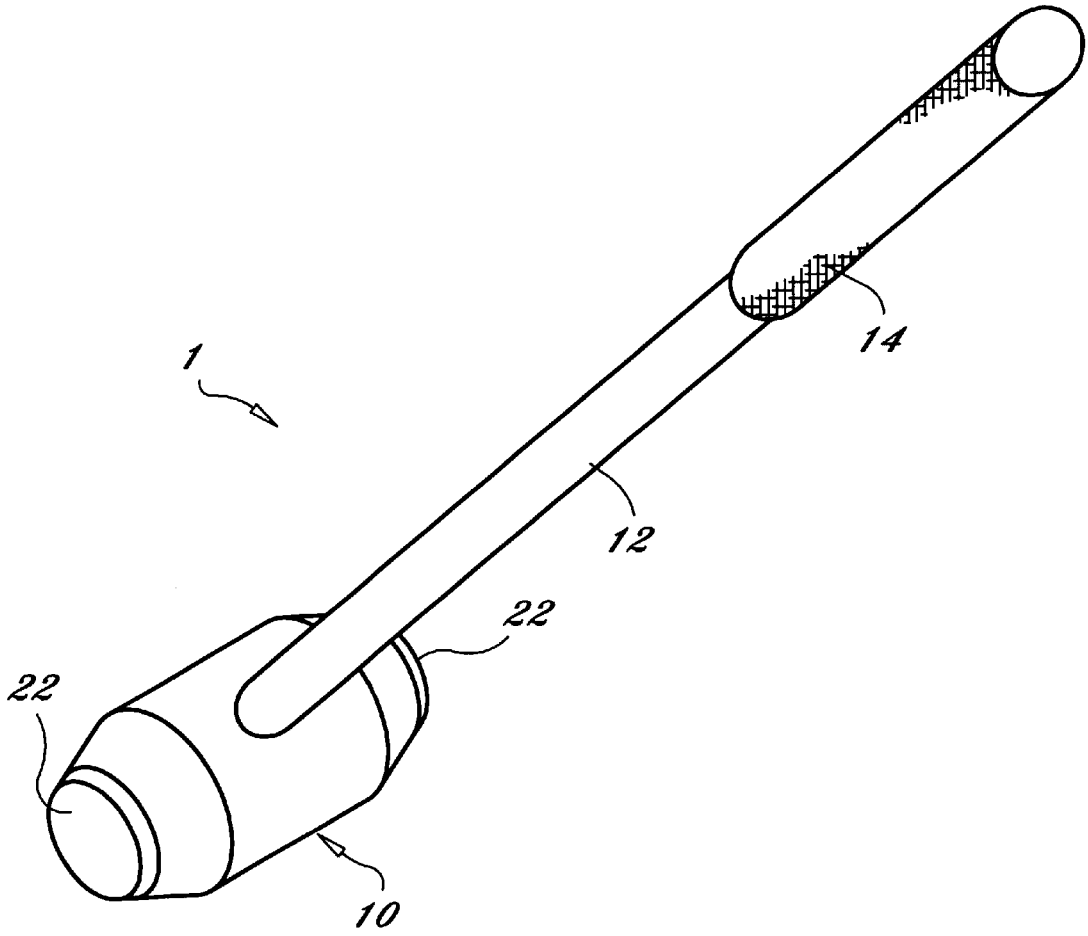
FIG. 1 is a perspective view of an improved putter in accordance with the present invention.
Figure 9:
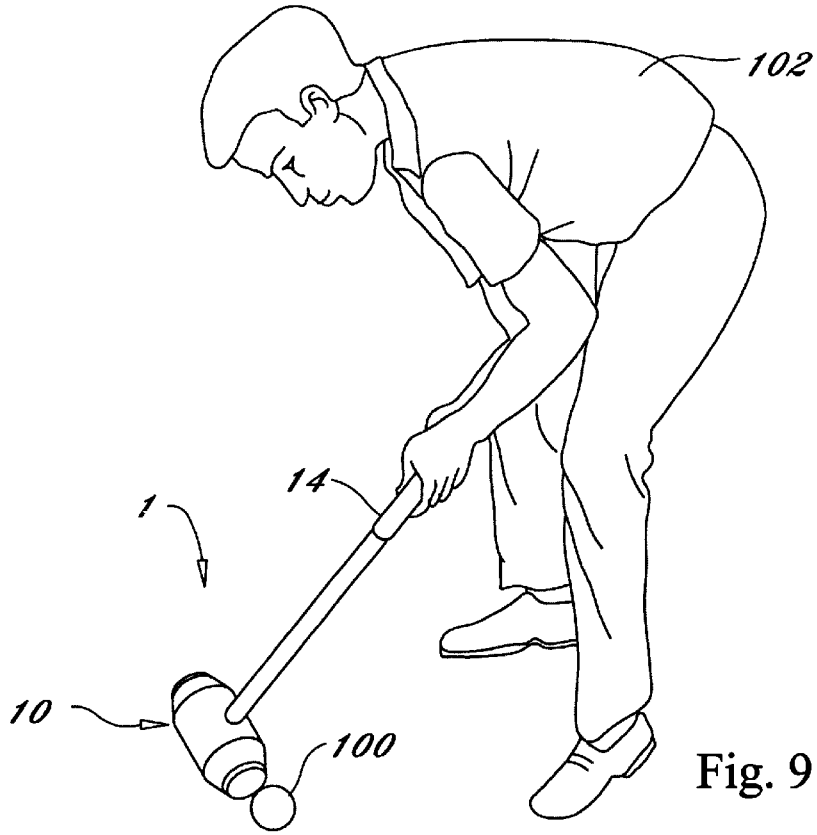
FIG. 9 is a side view of a golfer in a stance for an implementing an improved method of swinging a putter in accordance with the present invention.
Figure 10:
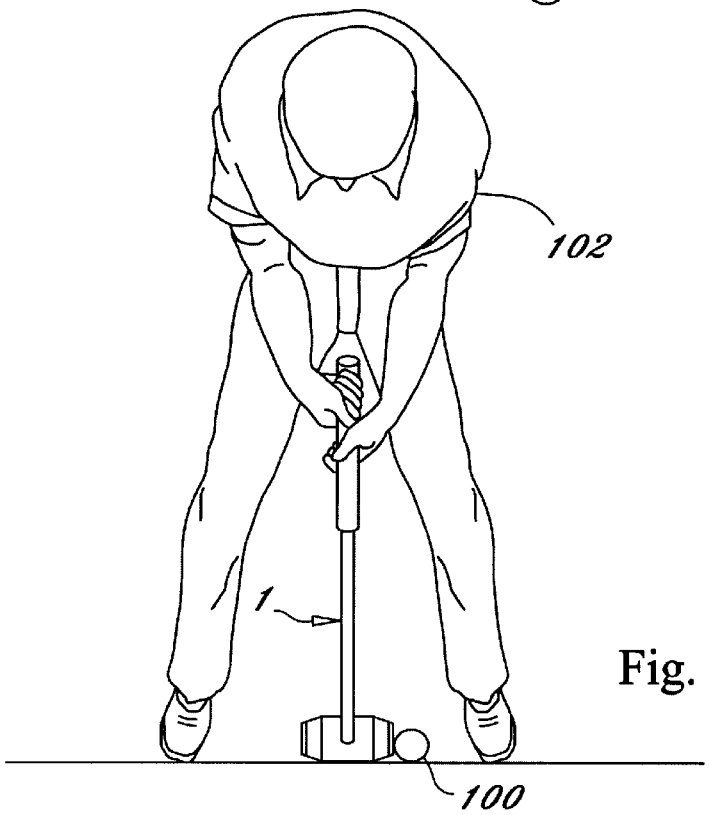
FIG. 10 is a front view of a golfer in a stance for an implementing an improved method of swinging a putter in accordance with the present invention.
Figure 11:
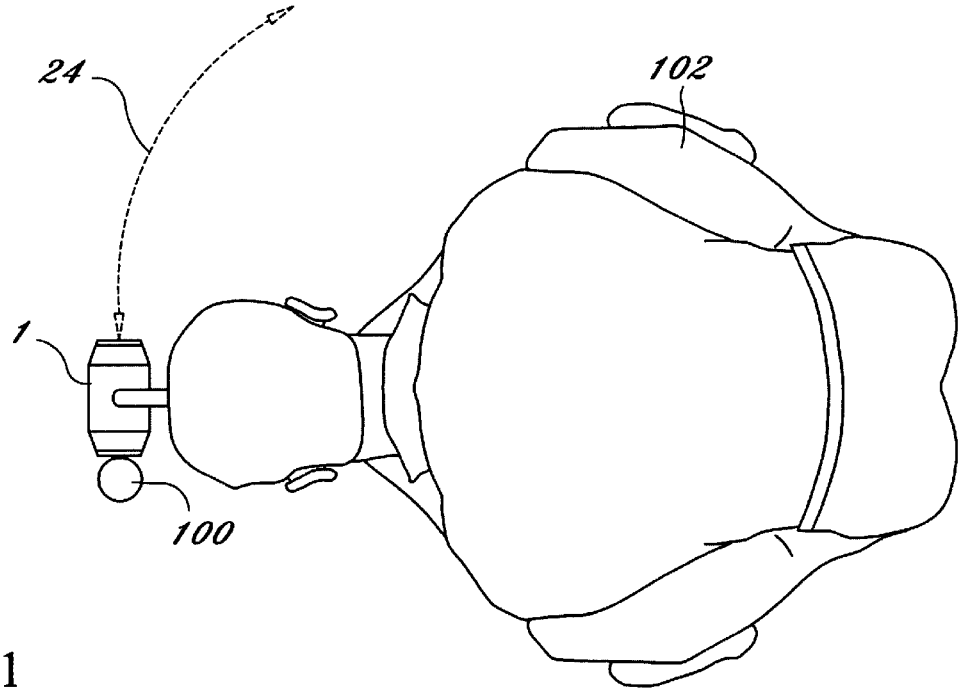
FIG. 11 is a top view of a golfer in a stance for an implementing an improved method of swinging a putter in accordance with the present invention.

With reference now to the drawings, and particularly to FIGS. 1 and 9, there is shown a method for improving putting skill. Other putters which are suitable for implementing the improved method of swinging may also be used. The method for improving putting skill includes an improved putter 1 and a swinging stance of specific features. With reference to FIGS. 10 and 11, the elements of the improved swinging method include gripping the improved putter 1 in the traditional fashion, securing at least one hand or a butt end of a hand grip 14 of the improved putter 1 against some part of the lower body, moving the putter head 10 back through an arcuate path, and retracing the arcuate path to strike the golf ball 100. Preferable position of the at least one hand or the butt end of the hand grip 14 is against the leg above the kneecap. The knee on which the improved putter 1 is resting may be extended to facilitate the swing.

Figure 12:
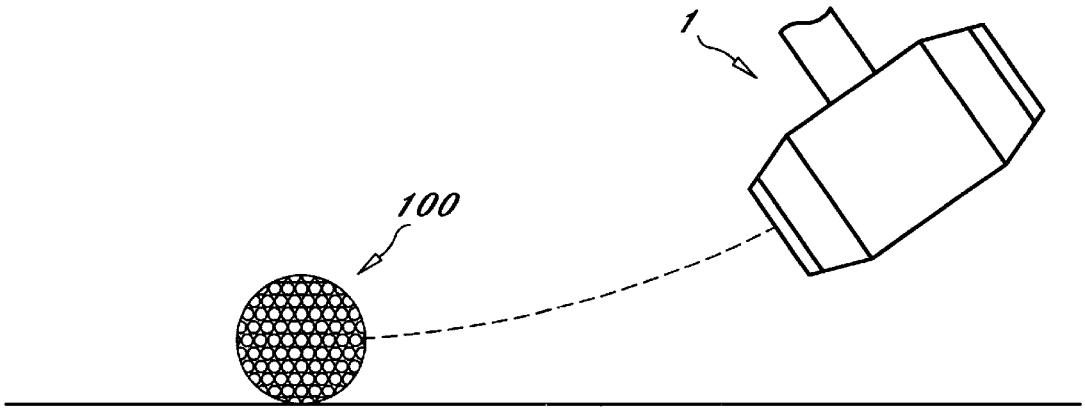
FIG. 12 is a side view of a putter head swung in a pendulum motion while making the arcuate swing in accordance with the present invention.

The golfer 100 may also place the improved putter 1 against other areas of the lower body besides the leg, above the kneecap. Other locations include farther up the thigh or inside the thigh (the closer to the femur, the better). The golfer 100 may also rest his right elbow on his right thigh, and left elbow on the left thigh; rest only the right elbow on the right thigh; or rest only the left elbow on the left thigh. The main objective is that at least one hand or the butt end of the hand grip are pivoted about some part of the lower body to produce an arcuate swing. While making the arcuate swing the putter head 10 is preferably swung parallel to the ground. The improved putter 1 may be slid on the green or slid slightly above the green during the putting swing. The improved putter 1 may also be swung in a pendulum motion in the vertical plane while making the arcuate swing in the horizontal plane as shown in FIG. 12. Other putters may also be utilized in a combination pendulum and arcuate swing. It is preferable that the player orient his head such that his eyes look substantially vertically downward on the golf ball 100.

The arcuate swing utilizes the advantages inherent in using a protractor or drawing compass for scribing a circle. With one end of a lever arm secured, while the writing tip is held in contact with the same plane as the anchor tip, the lever arm is constricted against moving in any path other than a circle. Furthermore, moving away from any point in an arc will result in the same angle of set-up orientation being obtained, once the lever arm is returned to said point.

Once a golfer is set up to a ball with the improved method of putting, they will be able to move the improved putter 1 away any distance his swing is required to produce the desired distance, and then return the club for impact at the same angle they set up at, hitting the ball at the same point of location on the club face he pre-positioned himself for. Achieving the desired club face angle at impact and making contact on the sweet spot of the putter are two of the most critical but difficult things to do in golf. The improved method and apparatus solve these problems.

It should be noted that although sliding the putter along the ground in an arc is the more productive method of swinging, some golfers may prefer to move the putter head upward from the ground while executing the backstroke, essentially producing a straight-line motion along the target line. The improved putting method and putter permits this, so long as the putter head 10 is returned to the ground at the time of impact.

Figure 4:
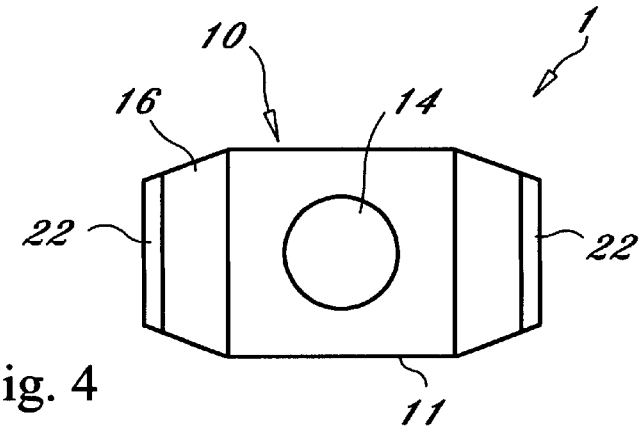
FIG. 4 is a top view of an improved putter in accordance with the present invention.
Figure 2:
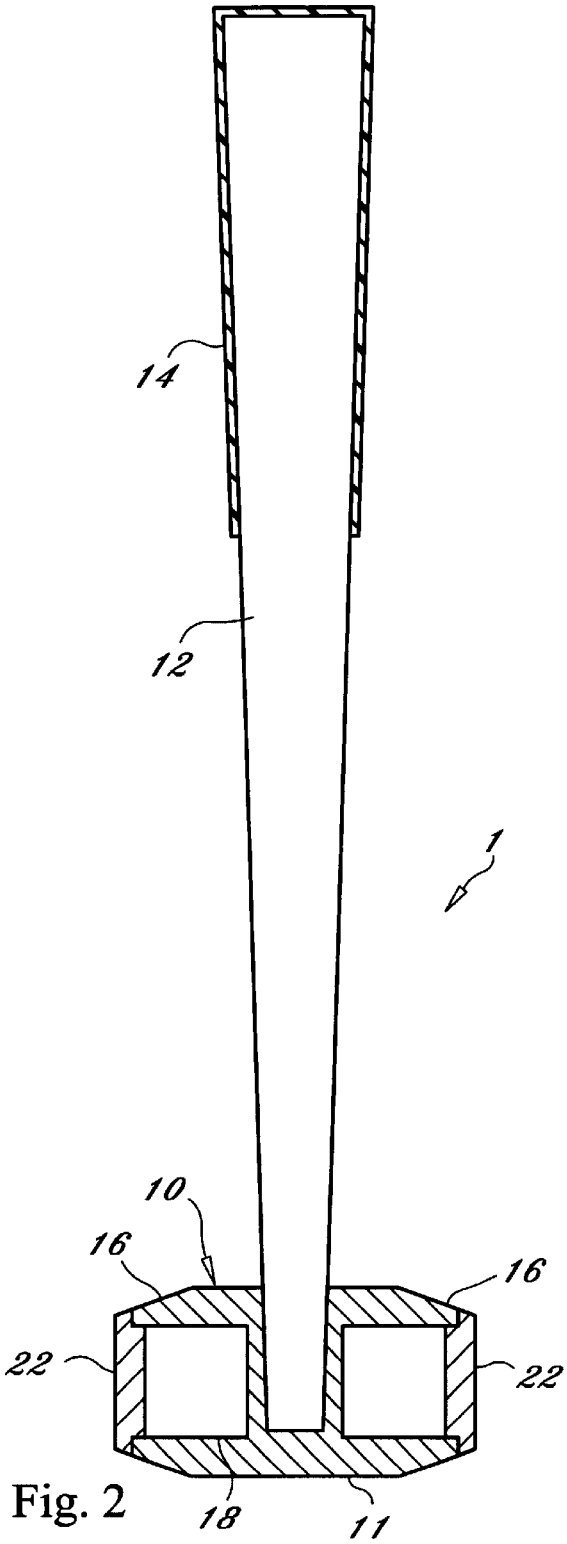
FIG. 2 is a side cross sectional view of an improved putter in accordance with the present invention.
Figure 3:
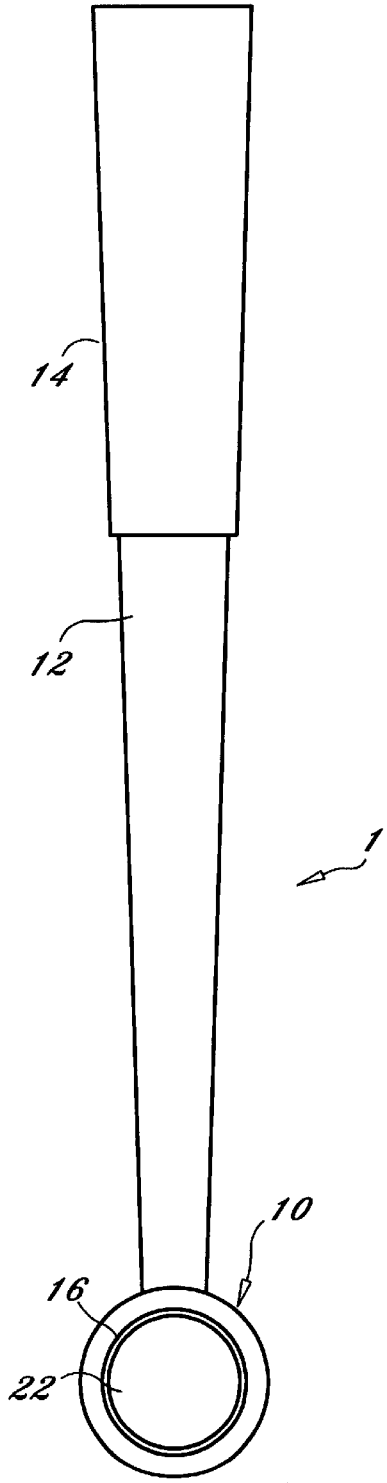
FIG. 3 is an end view of an improved putter in accordance with the present invention.
Figure 6:
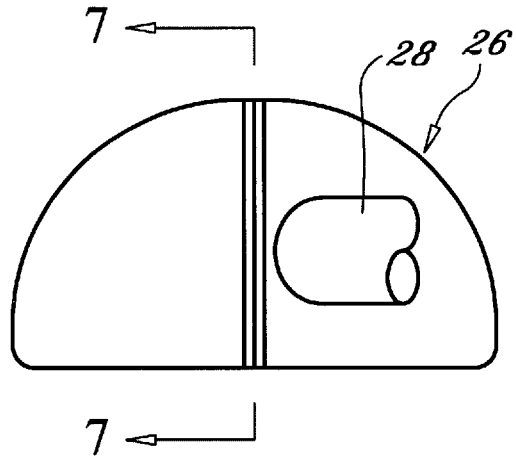
FIG. 6 is a top view of a putter head of a second embodiment improved putter in accordance with the present invention.

With reference to FIGS. 2–4, the improved putter 1 includes a putter head 10, shaft 12, and a hand grip 14. The putter head 10 preferably includes a putter body 11 and a pair of end plugs 22. Either end of the putter head 10 may be used to strike a golf ball 100. The putter body 11 has a substantially round cross section with a tapered area 16 on each end thereof. The substantially round cross section reduces the contact area between a bottom of the putter head 10 and a golfing surface. In addition it is already predominately radiused to slide both back and forth. Preferably, a plug bore 18 is formed on each end of the putter body 11 and a shaft bore 20 is formed in substantially the middle of an axial length of the putter body 11. The plug bore 18 is sized to receive a single end plug 22 which is inserted into the plug bore 18.

The end plug 22 may be attached to the putter body 11 by creating a press fit between the plug bore 18 and the end plug 20; placing an adhesive on the end plug 22 and plug 18; or with any other suitable attachment method. The weight of each end plug 22 is preferably of denser mass than the putter body 11. It is advantageous to have the majority of the mass of the putter head 10 directly behind the area where the golf ball is hit, unlike prior art putters which spread the weight relatively evenly along the striking face of the putter head. It is preferable to have a very hard end plug 22 or golf ball striking surface, as opposed to the softer facings of many prior art putters. It is preferable to apply a low friction coating to the putter head 10 such as TEFLON. The name TEFLON is a registered trademark of the DuPont Corporation.

Figure 3A:
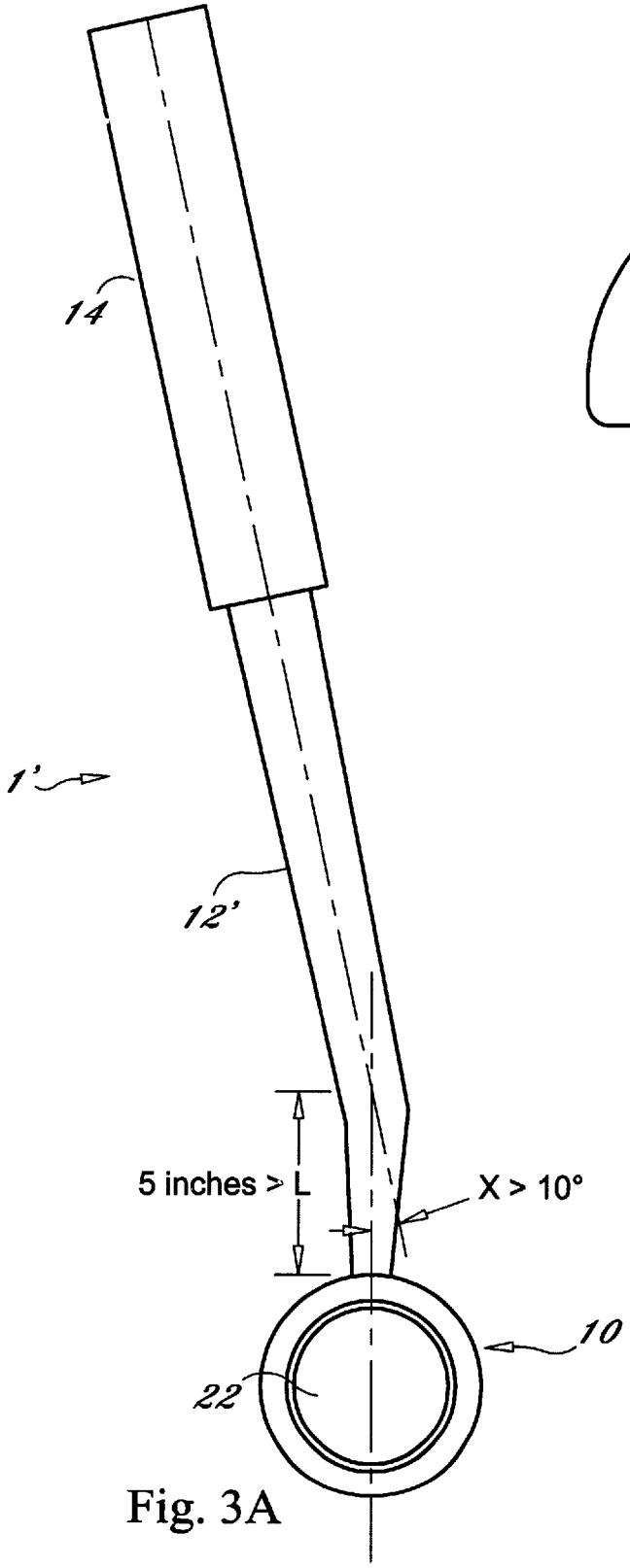
FIG. 3*a* is a side view of an improved putter with a bent shaft which conforms with USGA rules in accordance with the present invention.
Figure 7:
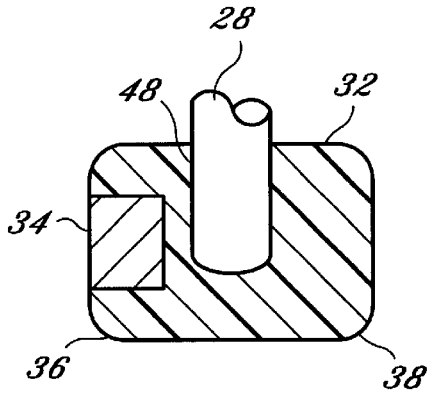
FIG. 7 is a cross sectional view of a putter head of a second embodiment improved putter in accordance with the present invention.
Figure 8:
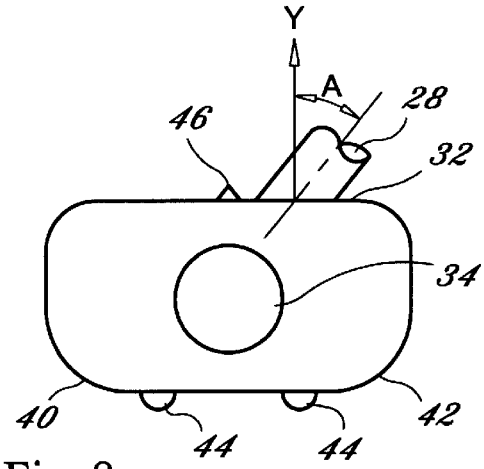
FIG. 8 is a front view of a putter head of a second embodiment improved putter in accordance with the present invention.
Figure 5:
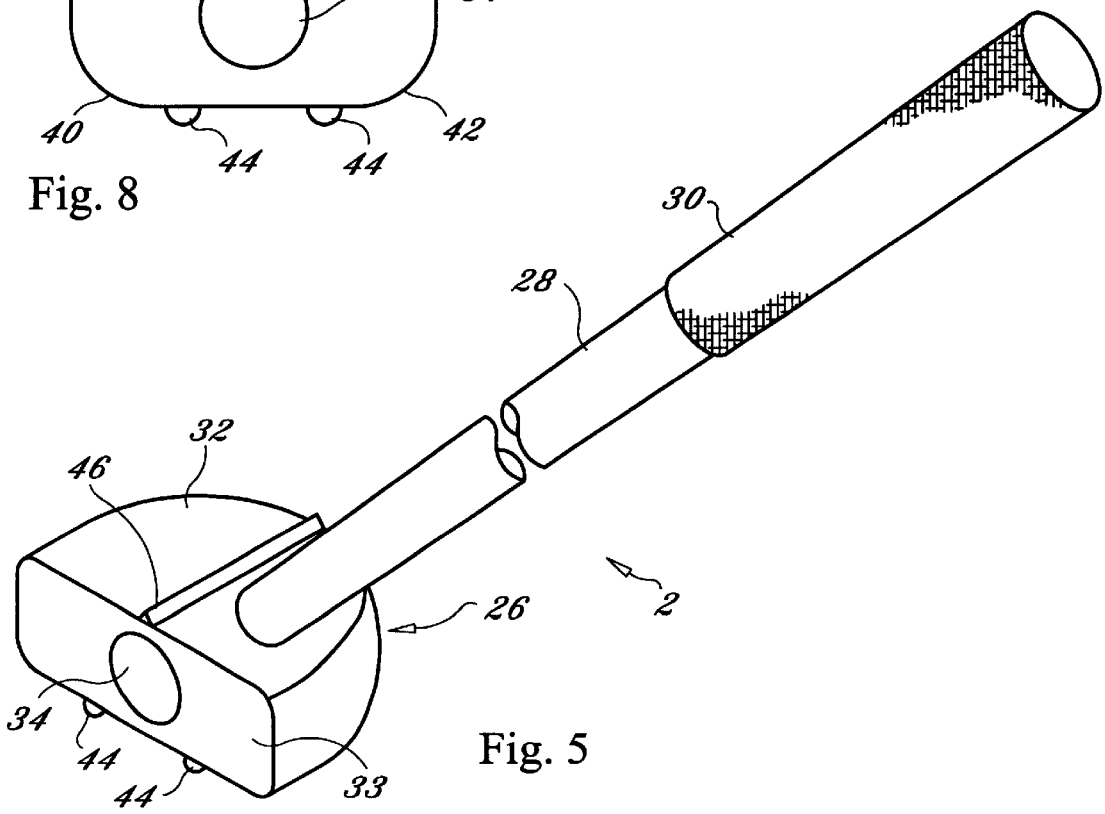
FIG. 5 is a perspective view of a second embodiment of an improved putter in accordance with the present invention.

The shaft bore 22 is sized to receive a first end of the shaft 12. The shaft 12 may be attached to the putter body 11 by creating a press fit between the shaft bore 18 and the shaft 12; placing an adhesive in the shaft bore 18 and on shaft 12; or with any other suitable attachment method. The hand grip 14 is sized to firmly receive a second end of the shaft 12. The length of the shaft 12 is at least 18 inches to conform with USGA rules. The shaft 12 is similar to other shafts used for other prior art putters or golf clubs, although the improved putter 1 permits noticeably shorter shaft lengths. The hand grip 14 is similar to other hand grips used for other prior art putters or golf clubs. According to USGA rules, a shaft must be bent 10 degrees toward the golfer within the first five inches of the putter head. If the improved putter 1 is nonconforming, an improved putter 1' with a bent shaft 12' is disclosed in FIG. 3*a*.

With reference to FIGS. 5–8, a second embodiment of an improved putter 2 includes a putter head 26, a shaft 28, and a hand grip 30. The putter head 26 preferably includes a putter body 32 formed around a hard rod 34. Putter heads with other configurations or designs may also be used. The hard rod 34 is shown with a round cross section, but other shaped cross sections may also be used. The hard rod 34 is placed in the center of the putter body, flush with the striking face 33 of the putter head 26. The hard rod 34 may extend the full distance to the back of the putter body 32 or only part of the way. A front of the hard rod 34 strikes the golf ball. The putter body 32 is preferably fabricated from polycarbonate plastic and the hard rod 34 from stainless steel. Other appropriate materials may also be used. It is preferable that the weight of the putter head 26 not exceed 280 grams.

A bottom of the putter body 32 is essentially flat, but it is preferable that the front edge 36, rear edge 38, left side edge 40, and right side edge 42 be rounded. It is also preferable to form at least one lengthwise rail 44 on a bottom of the putter head 26. It is preferable to apply a low friction coating to the putter head 10 such as TEFLON. An alignment indicator 46 is preferably placed on a top of the putter head 26 to indicate a center of the hard rod 34. The alignment indicator 46 may be a projection or a scribed line.

The shaft bore 48 is sized to receive a first end of the shaft 28. The shaft 28 may be attached to the putter body 32 by creating a press fit between the shaft bore 48 and the shaft 28; placing an adhesive in the shaft bore 48 and on shaft 28; or with any other suitable attachment method. It is preferable to locate the shaft bore 28 as shown in FIGS. 5–8, but other locations may also be used. The angle A of the shaft 28 relative to the putter head 26 is an angle from 35 to 85 degrees from a vertical axis Y. Preferably, the angle A of the shaft 28 relative to the putter head 26 (lie angle) is such that it would allow a golfer to place at least one hand or a butt end of the hand grip 30 above the knee cap.

The hand grip 30 is sized to firmly receive a second end of the shaft 28. The length of the shaft 12 is at least 18 inches to conform with USGA rules. The shaft 28 is similar to other shafts used for other prior art putters or golf clubs, except for the length. The hand grip 14 is similar to other prior art hand grips used for other putters or golf clubs. The shaft 28 is preferably fabricated from a light weight material such as graphite, but could be made from other suitable materials.

A hosel may be formed on a top of the putter head 26 which receives a first end of the shaft 28. The hosel may also allow adjustment for providing a varying lie angle.

The central differentiating feature between a prior art putter and the improved putters 1 and 2 is in the lie angle of the shaft, the angle formed between the shaft and the ground. In a traditional putter, the shaft is oriented almost perpendicular to both the putter head and the ground. As previously mentioned, USGA rules require a minimum of 10 degrees offset between the head and the grip of putters, in the plane perpendicular to the line of intended ball travel, and although there is no rule governing the maximum offset, few putters are produced which exceed this standardized offset by more than 20 degrees.

With the improved putters 1 and 2, the shaft is tilted towards the golfer at a typical angle of 45 degrees, while maintaining a putter head position that is parallel to the ground, with a contact face that is perpendicular to the intended ball path. The length of the shaft is a minimum of 18 inches, but can be extended so as to allow comfort of people of differing heights. In most cases, the shaft length will be considerable shorter than the typical shaft length of 36 inches, allowing the golfer to be that much closer to the ball, and improving control.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of improving a putting swing comprising the steps of:

(a) providing a putter having a putter head at one end of a shaft and a hand grip at an opposite end of said shaft;

(b) resting one of a first hand of a first arm and a butt end of said hand grip against a portion of a first leg;

(c) placing a portion of a second arm on a portion of a second leg such that said putter may be pivoted relative to the first leg, each arm including an elbow, forearm, wrist and hand;

(d) holding said putter with both hands; and (e) placing said putter head near a golf ball, pivoting said putter behind the golf ball in an arc in a horizontal plane that is substantially parallel to a putting surface, retracing said putter back along said arc in the horizontal plane to hit the golf ball.

2. The method of improving a putting swing of claim 1, further comprising the step of:

(f) sliding said putter on the putting surface during a putting stroke.

3. The method of improving a putting swing of claim 1, further comprising the step of:

(f) moving said putter head slightly above the green during a putting stroke.

4. The method of improving a putting swing of claim 1, further comprising the step of:

(f) swinging said putter head in a pendulum motion in a vertical plane that is perpendicular to the horizontal plane while said putter head is pivoted in said arc in the horizontal plane.

5. The method of improving a putting swing of claim 1, further comprising the step of:

(f) swinging said putter with a minimum of follow through after hitting the golf ball.

6. The method of improving a putting swing of claim 1, further comprising the step of:

(f) forming a low friction surface on a bottom of said putter head to permit the smooth execution of a putting stroke while said putter head is in contact with the putting surface.

7. The method of improving a putting swing of claim 1, further comprising the step of:

(f) providing said putter head with said shaft extending from said putter head at an angle of between 35 to 85 degrees from a vertical axis, the vertical axis being substantially perpendicular to the putting surface.

8. The method of improving a putting swing of claim 1, further comprising the step of:

providing said putter head with substantially all of the mass of said putter head thereof being located directly behind the ball.

9. A method of improving a putting swing comprising the steps of:

(a) providing a putter having a putter head at one end of a shaft and a hand grip at an opposite end of said shaft;

(b) resting one of a first hand of a first arm and a butt end of said hand grip against a portion of a first leg;

(c) locating a portion of a second arm relative to a portion of a second leg such that said putter may be pivoted relative to the first leg, each arm including an elbow, forearm, wrist and hand;

(d) holding said putter with both hands; and (e) placing said putter head near a golf ball, pivoting said putter behind the golf ball in an arc in a horizontal plane that is substantially parallel to a putting surface, retracing said putter back along said arc in the horizontal plane to hit the golf ball.

10. The method of improving a putting swing of claim 9, further comprising the step of:

(f) sliding said putter on the putting surface during a putting stroke.

11. The method of improving a putting swing of claim 10, further comprising the step of:

(f) moving said putter head slightly above the green during a putting stroke.

12. The method of improving a putting swing of claim 9, further comprising the step of:

(f) swinging said putter head in a pendulum motion in a vertical plane that is perpendicular to the horizontal plane while said putter head is pivoted in said arc in the horizontal plane.

13. The method of improving a putting swing of claim 9, further comprising the step of:

(f) swinging said putter wit h a minimum of follow through after hitting the golf ball.

14. The method of improving a putting swing of claim 9, further comprising the step of:

(f) forming a low friction surface on a bottom of said putter head to permit the smooth execution of a putting stroke while said putter head is in contact with the putting surface.

15. The method of improving a putting swing of claim 9, further comprising the step of:

(f) providing said putter head with said shaft extending from said putter head at an angle of between 35 to 85 degrees from a vertical axis, the vertical axis being substantially perpendicular to the putting surface.

16. The method of improving a putting swing of claim 9, further comprising the step of:

providing said putter head with substantially all of the mass of said putter head thereof being located directly behind the ball.

17. A method of improving a putting swing comprising the steps of:

(a) holding said putter with both hands, said putter having a putter head at one end of a shaft and a hand grip at an opposite end of said shaft, said shaft extending from said putter head at an angle of between 35 to 85 degrees from a vertical axis, the vertical axis being substantially perpendicular to the putting surface;

(b) resting one of a first hand of a first arm and a butt end of said hand grip against a portion of a first leg;

(c) placing a portion of a second arm on a portion of a second leg such that said putter may be pivoted relative to the first leg, each arm including an elbow, forearm, wrist and hand;

(d) placing said putter head of said putter near a golf ball, pivoting said putter behind the golf ball in an arc in a horizontal plane that is substantially parallel to the putting surface, retracing said putter back along said arc in the horizontal plane to hit the golf ball.

18. The method of improving a putting swing of claim 17, further comprising the step of:

(e) sliding said putter on the putting surface during a putting stroke.

19. The method of improving a putting swing of claim 17, further comprising the step of:

(e) moving said putter head slightly above the green during a putting stroke.

20. The method of improving a putting swing of claim 17, further comprising the step of:

(e) swinging said putter head in a pendulum motion in a vertical plane that is perpendicular to the horizontal plane while said putter head is pivoted in said arc in the horizontal plane.

21. The method of improving a putting swing of claim 17, further comprising the step of:

(e) swinging said putter with a minimum of follow through after hitting the golf ball.

22. The method of improving a putting swing of claim 17, further comprising the step of:

(e) forming a low friction surface on a bottom of said putter head to permit the smooth execution of a putting stroke while said putter head is in contact with the putting surface.

23. The method of improving a putting swing of claim 17, further comprising the step of:

providing said putter head with substantially all of the mass of said putter head thereof being located directly behind the ball.

* * * * *